US006398664B1

(12) United States Patent
Choi

(10) Patent No.: US 6,398,664 B1
(45) Date of Patent: Jun. 4, 2002

(54) PRACTICE GOLF CLUB

(76) Inventor: Woong-Jae Choi, #106-704, Yangji-Geumho Apt., 34, Sunae-dong, Bundang-gu, Seongnam-shi, Kyonggi-do (KR)

( * ) Notice: Subject to any disclaimer, the term of this patent is extended or adjusted under 35 U.S.C. 154(b) by 0 days.

(21) Appl. No.: 09/705,717

(22) Filed: Nov. 6, 2000

(30) Foreign Application Priority Data

Jun. 1, 2000 (KR) ..... 2000-30157

(51) Int. Cl.[7] ..... A63B 69/36
(52) U.S. Cl. ..... 473/228; 473/232; 473/257
(58) Field of Search ..... 473/232, 231, 473/257, 228, 463, 226, 233, 242, 258, 260

(56) References Cited

U.S. PATENT DOCUMENTS 1,428,015 A * 9/1922 Dienner
3,033,575 A * 5/1962 Hause
3,565,444 A * 2/1971 Larocca
5,362,048 A * 11/1994 Haste
5,842,808 A * 12/1998 Potter

FOREIGN PATENT DOCUMENTS

GB 2103492 * 2/1983

* cited by examiner

*Primary Examiner*—Sebastiano Passaniti
(74) *Attorney, Agent, or Firm*—Fleshner & Kim, LLP

(57) ABSTRACT

The present invention relates to a practice golf club which enables a beginner to learn not to reduce his driving range and correct an impact misbehavior due to an excessive force on a grip during a downswing by himself. The present invention of a practice golf club includes a grip grabbed by golfer's hands, a head impacted with a golf ball, and a shaft connecting the grip to the head, includes a pair of folding shafts of which one ends are fixed to a head neck of the head and of which other ends are fixed to the shaft, wherein the folding shafts are folded when a force is exerted on the grip during a downswing, a bending-prevention means fixed to the shaft to prevent the head from being bent during follow-through after impact of the golf ball wherein the bending-prevention means is fixed to prevent the head from moving to a direction left of a center line of the shaft, and a forcing means attached rotatively to the shaft wherein the head receives a force by the forcing means during address and backswing and wherein the folding shafts are folded during downswing by releasing the force of the head.

4 Claims, 11 Drawing Sheets

PRACTICE GOLF CLUB

BACKGROUND OF THE INVENTION

1. Field of Invention

The present invention relates to a practice golf club which enables a beginner to learn not to reduce his driving range and correct an impact misbehavior due to an excessive force on a grip during a downswing.

2. Discussed of Related Art

FIG. 1 shows a golf club according to a prior art.

Referring to FIG. 1, a golf club is mainly comprised of a head 1 configured to impact with a golf ball, a shaft 2, and a grip 3.

FIG. 2 shows a principle of applying a force on a golf club during a swing.

Referring to FIG. 2, in order to extend a driving range of an impacted golf ball, a player should perform an impact with a rotational torque attained by an inertial force and a centrifugal force of the head 1 by downswing without enforcing on the grip 3.

Unfortunately, a golf beginner tends to swing a golf club by applying excessive force on his hands grabbing the grip 3 during downswing to extend the driving range of a golf ball.

The head 1, which is far away from the grip 3 via shaft 2, is relatively heavier than the grip 3 or the shaft 2, thereby having the centroid 0 of the golf club placed near the head 1.

Once the beginner applies a force F to the rotational direction of the club through the grip to extend a driving range of the golf ball on impact, the shaft 2 revolves counterclockwise by the force F applied to the grip 3 centering around the centroid 0 while another force $F_1$ is enforced on the head 1 in the opposite direction, which is the antidirection of the rotational torque resulting from the gravity and die centrifugal force of the head during the downswing of the golf club, of the other force F applied to the grip 3. In this case, the motion of the head 1 is more flexible than that of the fixed grip 3.

Therefore, the force F applied to the grip 3 is proportional to the other force F1 applied to the head 1, thereby causing the end of the shaft to be bent to a predetermined degree. Thus, the pliable shaft reduces the rotational torque rather than transfer the force to the golf ball on impact, thereby reducing the driving range of the golf ball due to the unnecessary loss of force.

For these reasons, the beginner should practice hard not to apply excessive force to the grip 3 during downswing.

To improve the problem, a conventional practice golf club is suggested as shown in FIG. 3.

Referring to FIG. 3, a head 5 of a practice golf club is bent over when an excessive force is applied to grip 7 during downswing due to the separation of a shaft 6 from the head 5 and by combining the shaft 6 and the head 5 with a hinge 8.

Unfortunately, the conventional practice golf club fails to achieve a correct address stance since the head combined with the hinge swings left to right due to the enforced address stance.

And, it is difficult to have a correct posture of backswing since the hinge-combined head is waved by gravity when the address stance is switched to a backswing stance, that is, the head is at the peak position of the backswing.

Moreover, it is hard to sense that the head becomes bent over since the head hung from the end of the shaft keeps on rotating when an excessive force is applied to the grip during downswing.

As mentioned in the above explanation, the practice golf club according to the prior art fails to inform a beginner of a misbehavior when an excessive force is placed on a grip during addressing, backswing, downswing and the like, especially, during downswing.

SUMMARY OF THE INVENTION

Accordingly, the present invention is directed to a practice golf club that substantially obviates one or more of the problems due to limitations and disadvantages of the related art.

The object of the present invention is to provide a practice golf club which enables a beginner golfer to correctly practice a downswing by preventing the beginner from applying an excessive force on a grip.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention of a practice golf club including a grip grabbed by golfer's hands, a head impacted with a golf ball, and a shaft connecting the grip to the head, includes a pair of folding shafts, one end of which is fixed to a neck of the head and the other end of which is fixed to the shaft, wherein the folding shafts are folded when a force is exerted on the grip during downswing, a bending-prevention means fixed to the shaft to prevent the head from being bent during follow-through after impact of the golf ball, wherein the bending-prevention means is fixed to prevent the head from moving in a direction left of a center line of the shaft, and a forcing means attached rotatively to the shaft, wherein the head receives a force by the forcing means during address and backswing, and wherein the folding shafts arc folded during downswing by releasing the force of the head.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this application, illustrate embodiments of the inventing and together with the description serve to explain the principle of the invention.

DETAILED DESCRIPTION OF PREFERRED EMBODIMENTS

Reference will now be made in detail to the preferred embodiments of the present invention, examples of which are illustrated in the accompanying drawings.

Figure 1:
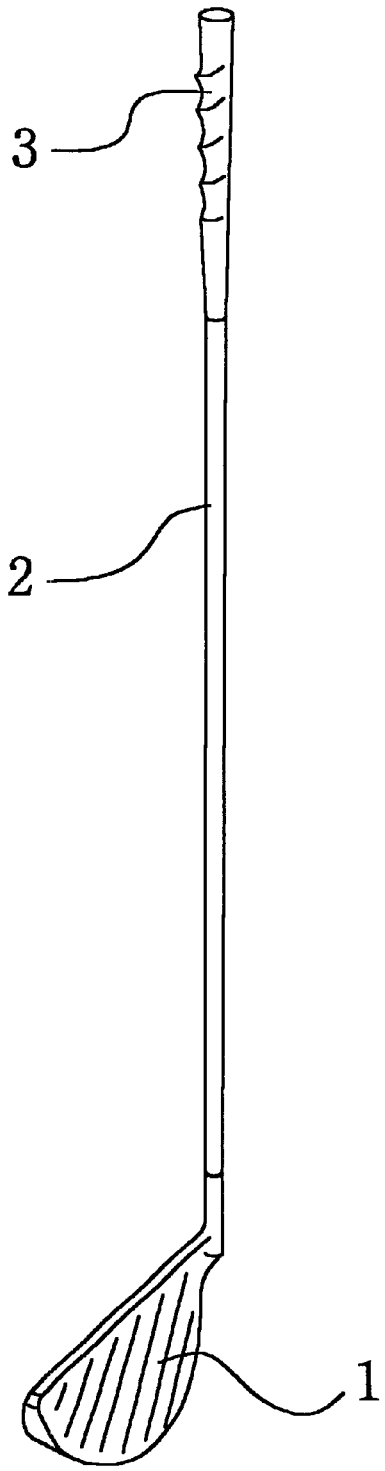
FIG. 1 PRIOR ART
FIG. 1 shows a golf club according to a prior art.
Figure 2:
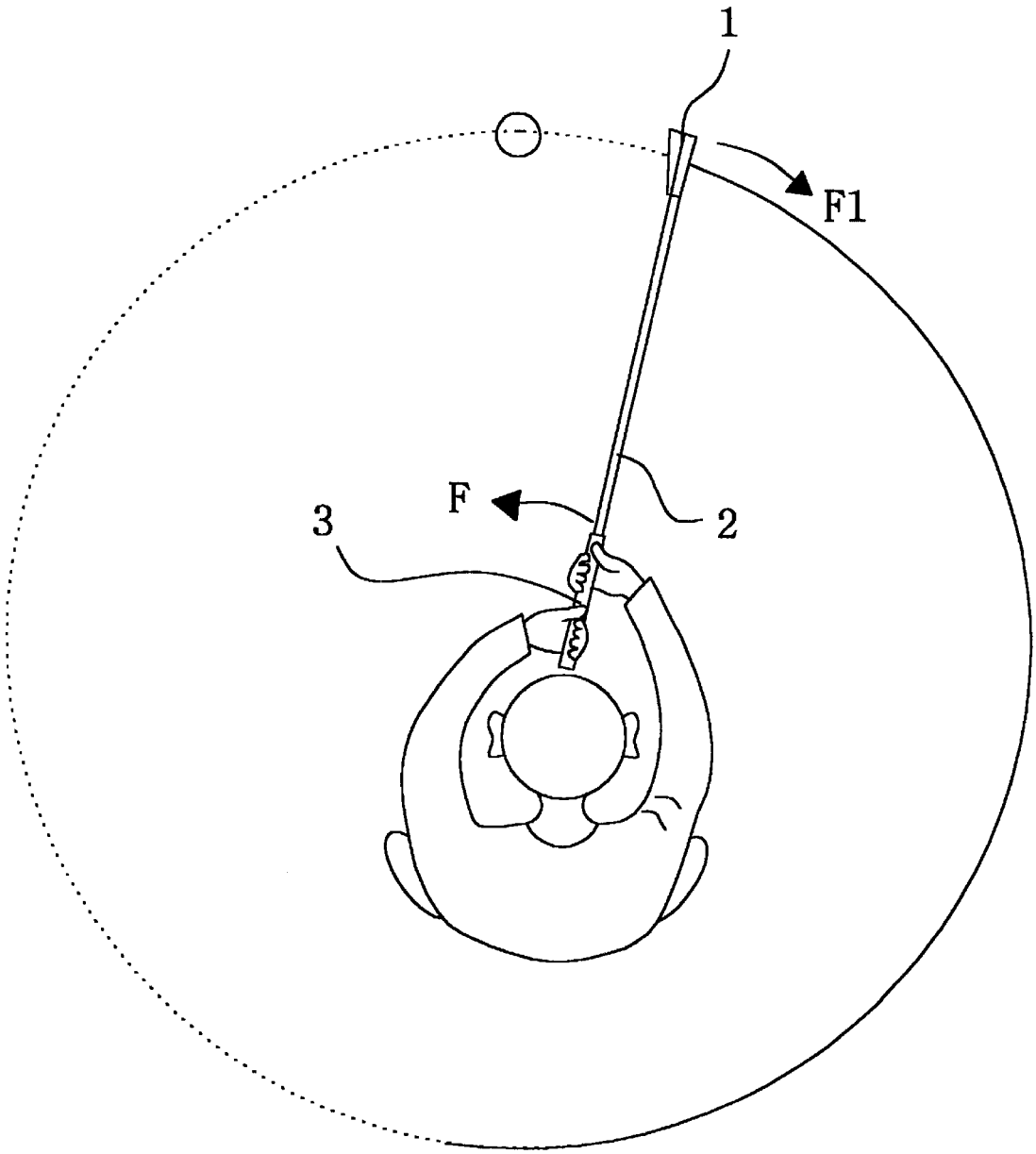
FIG. 2 shows a principle of applying a force on a golf club during a swing.
Figure 3:
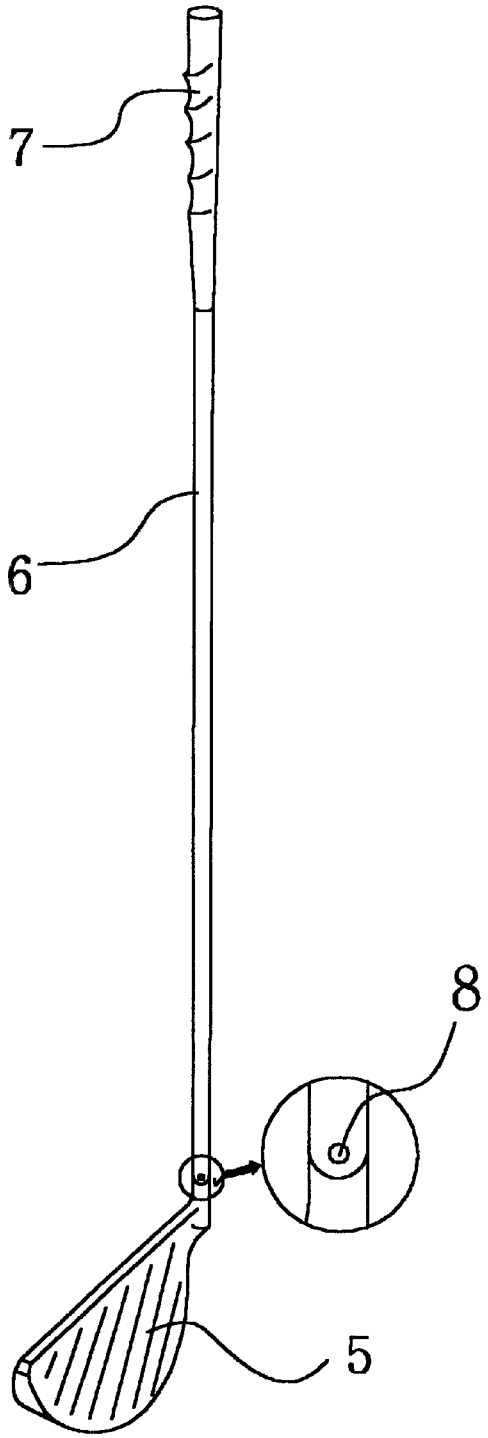
FIG.3 PRIOR ART
FIG. 3 shows a practice golf club according to a prior art.
Figure 4:
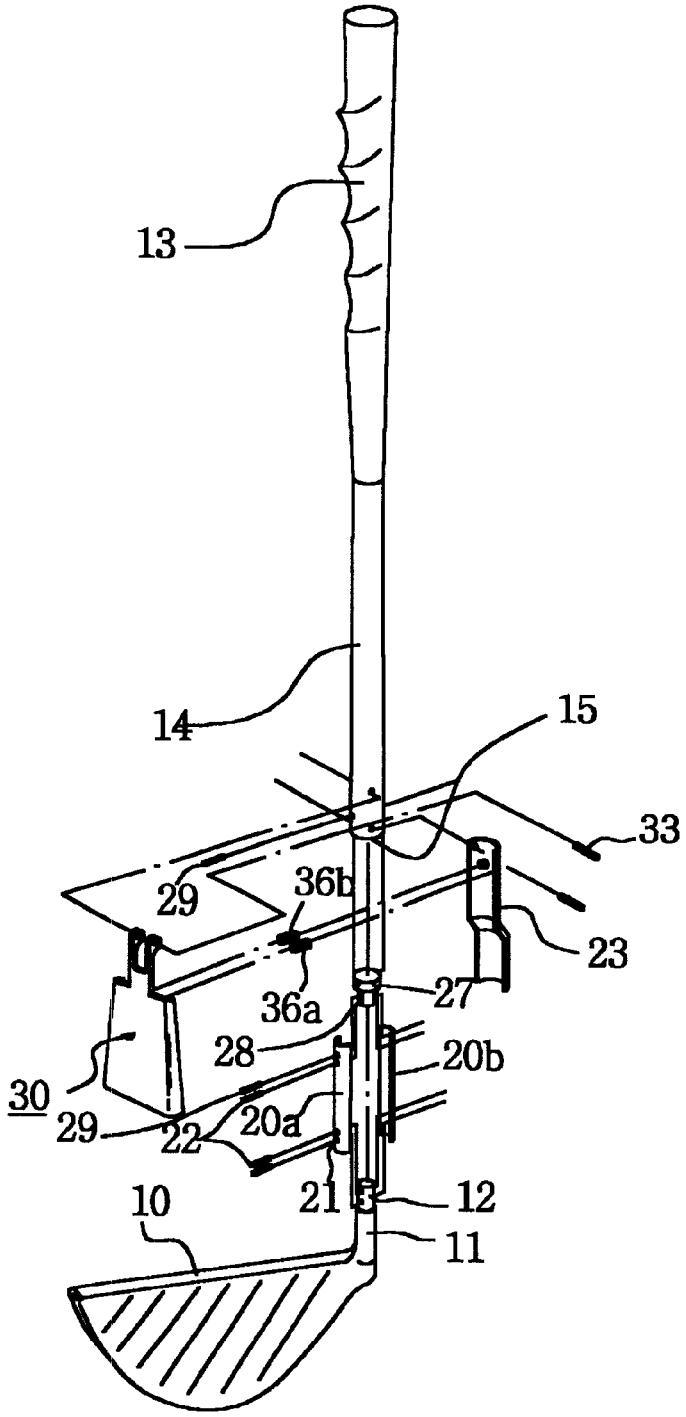
FIG. 4 shows a bird's eye view of disassembled parts of a practice golf club according to the present invention.
Figure 5:
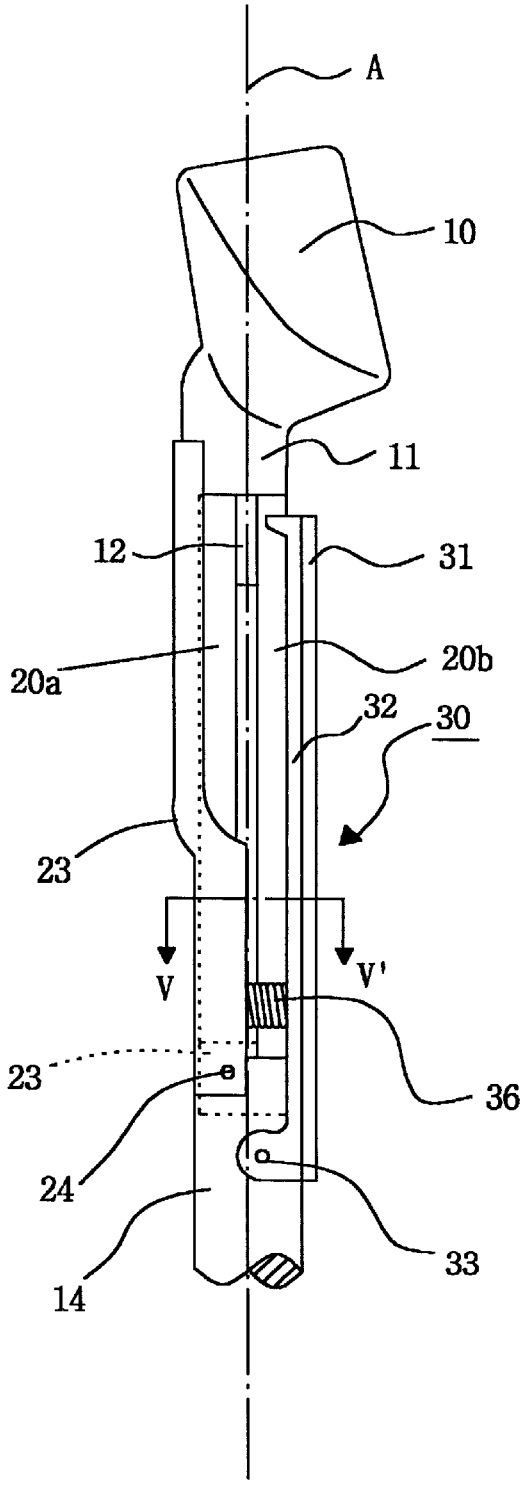
FIG. 5 shows subject parts of a practice golf club according to the present invention.
Figure 6:
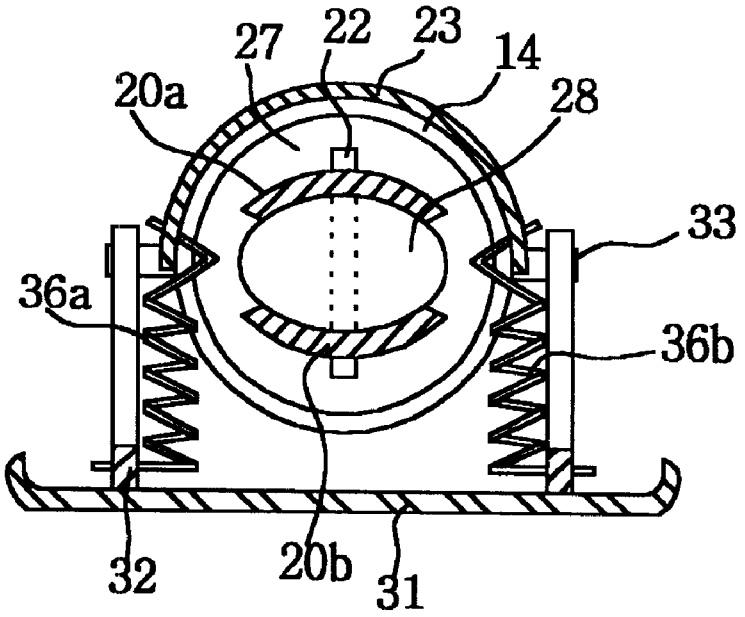
FIG. 6 shows a cross-sectional view of the subject parts in FIG. 5 bisected along with the line VI—VI according to the present invention.

FIG. 4 shows a bird's eye view of disassembled parts of a practice golf club according to the present invention, and FIG. 5 shows subject parts of a practice golf club according to the present invention.

Referring to FIG. 4, a sensing means which senses that an excessive force is applied to the grip is installed on a shaft 14 of a practice golf club of the present invention, which basically includes a grip 13, a shaft 14, and a head 10. In this case, the sensing means prevents the rotational torque, which is generated from an inertial force and a centrifugal force on impact, of the head 10 from being reduced due to the excessive force applied to the grip 13 during downswing.

The sensing means of the practice golf club according to the present invention will be explained specifically in the following description.

Referring to FIG. 4 and FIG. 5, the sensing means of the practice golf club according to the present invention includes folding shafts 20*a* and 20*b*, a bending-prevention means 23, and a forcing means 30.

The folding shafts 20*a* and 20*b*, one end of which is fixed to a neck 12 of head 10 and the other end of which is fixed to the shaft 14, are folded when a force is applied to the grip 13 during downswing.

The bending-prevention means 23 fixed to the shaft 14 to support the head prevents the head 10 from being bent in the direction left of a shaft center line during follow-through after impact with a golf ball.

And, the forcing means 30, which is attached to the shaft 14 as well as moves rotationally, applies a force to the head during address and backswing but releases the force from the head by bending the folding shafts 20*a* and 20*b* during downswing.

Figure 7:
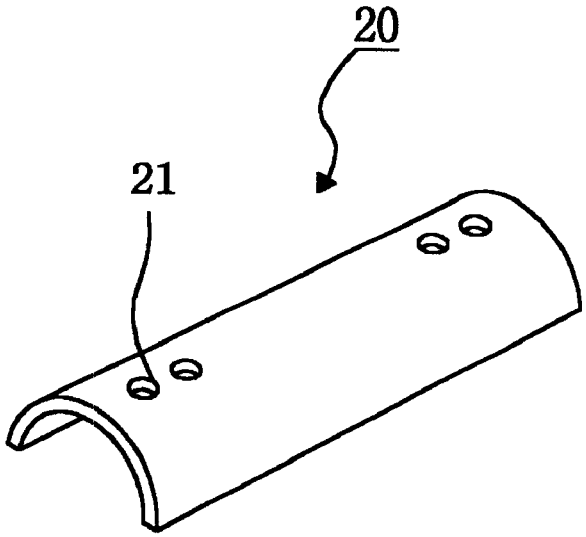
FIG. 7 shows a folding shaft of a practice golf club according to the present invention.

The folding shafts 20*a* and 20*b* are folded in accordance with the size of the external force which is activated thereon but restores their figures unless the external force works. As shown in FIG. 7, a plurality of clamping holes 21 made of an elastic substance are formed in each of the folding shafts consisting of a pair of hemi(semi)-elliptical panels the insides of which confront each other.

In this case, the folding shafts 20*a* and 20*b* are not folded when the user does not put a force on the grip 13, unless a force reducing a rotational torque in the opposite direction of the rotational direction of the head 10 is generated. On the other hand, when a force reducing the rotational torque is generated in the opposite rotational direction of the head 10 provided that the user puts a force on the grip 13, the folding shafts 20*a* and 20*b* tend to be folded abruptly.

One end of the folding shafts 20*a* and 20*b* having the clamping holes 21 are fixed to protuberances 12 of the neck 11 by rivets 22.

And, the other end of the folding shafts 20*a* and 20*b* fixed to the protuberances 12 of the head 10 are fixed by another rivet 22 to other protuberances 28 of a keeper 27 inserted into a shaft opening 15.

The round shaped keeper 27 inserted into the opening of the shaft may be fixed to the shaft 14 by a rivet 29 or by pressing the opening 15.

Figure 8:
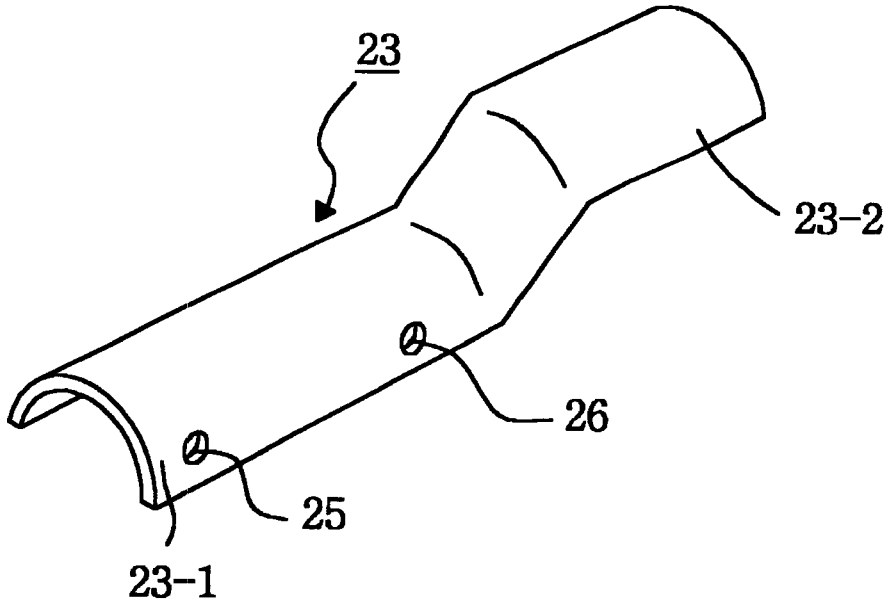
FIG. 8 shows a panel for preventing a practice golf club from being bent over according to the present invention.
Figure 9:
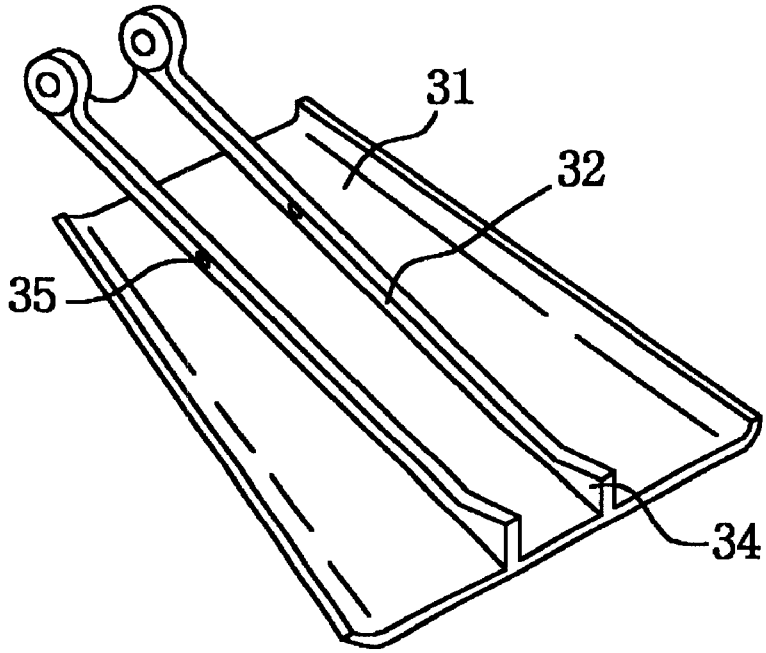
FIG. 9 shows a forcing means of a practice golf club according to the present invention.

The bending-prevention means 23, as shown in FIG. 5, is installed for preventing the head 10 from being folded in the direction left of the center line A of the shaft 14 during follow-through after impact. The bending-prevention means 23, as shown in FIG. 8, comprises a hemi-elliptical panel 23, in which a clamping hole 25 to be fixed to the shaft 14 by rivets and fixing holes 26 coupled with the other ends of elastic springs 36*a* and 36*b* are provided. The other end of the panel 23-2 protrudes externally out higher than the one end of the panel 23-1.

One end 23-1 of the bending prevention panel 23 is fixed to the shaft 14 by inserting a rivet 24 into the clamping hole 25, while the other end 23-2 of the bending-prevention panel 23 extends to the neck 11 to block the head 10 so as to prevent the head from being folded to the left of the center line A during follow-through.

The forcing means 30 fixes the head 10 during address and back-swing, as well as releasing the accelerating force of the head to have the folding shafts 20*a* and 20*b* folded according to the force applied to the grip 13 during down-swing. The spring's elastic restoration is used for applying a force to the head 10 by the forcing means 30, while air resistance is used for releasing the force of the forcing means 30 during down-swing.

Specifically, the forcing means 30, which is formed on the opposite side of the bending-prevention panel 23 centering around the shaft 14, as shown in FIGS. 4 to 6 and FIG. 9, comprises a support plate 31 to receive an air-resistance during downswing, a pair of supports 32 which are fixed to one side of the support plate 31 and arc movable by the hinges 33, and a pair of elastic springs 36*a* and 36*b*, one end of which is fixed to the predetermined locations of the supports 32 and the other end of which is attached to the bending prevention panel 23.

Fixing holes 35 to which ends of the elastic springs 36*a* and 36*b* are fixed are formed in the supports 32, while the protuberances 34 are formed to the opposite side of the hinge 33 fixing joints to accelerate a force by supporting the neck 11.

The practice golf club according to the present invention enables a golfer to practice a golf-swing to prevent the driving range of an impacted golfball from being reduced due to the lessened rotational torque of the head 10 on impact as the golf-beginner applies an excessive force on the grip 13.

An action of 'address' will be explained in the following description.

The address is set at the state of FIG. 5.

Referring to FIG. 5, the folding shafts 20*a* and 20*b* are fixed even though the head 10 is rocked left to right by forcing the grip 13 during address.

Namely, as the head 10 receives a force by the supports 32 and the support plate 31 suspended elastically by the elastic springs 36*a* and 36*b*, the folding shafts 20*a* and 20*b* provide a correct address stance without shaking the head 10 as well as the conventional golf club.

Then, backswing will be explained.

The folding shafts 20*a* and 20*b* of the practice golf club according to the present invention are not bent over by the gravity of the head at the peak of the backswing.

Namely, as is the case with the address, a correct backswing stance is provided by the folding shafts 20*a* and 20*b* which are not folded by the gravity of the head 10 that receives a force by the support plate 31 and the supports 32 suspended elastically by the elastic springs 36*a* and 36*b*.

And, 'downswing' will be explained in the following description.

The practice golf club according to the present invention provides a natural downswing when the grip 13 receives no external force from the user.

Figure 10:
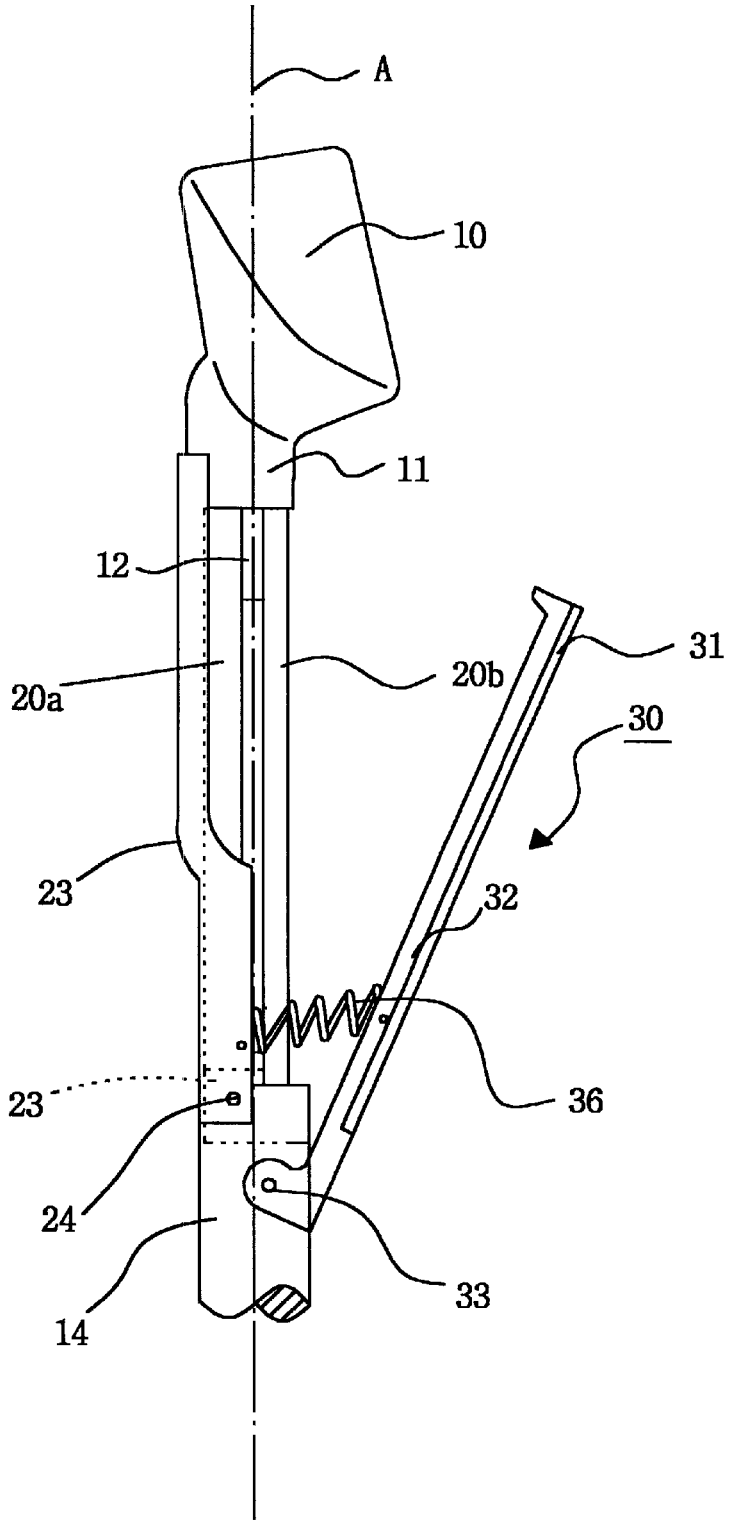
FIG. 10 and FIG. 11 show the operations of a practice golf club according to the present invention during downswing.

Namely, as shown in FIG. 10, during downswing when no external force is exerted on the grip 13, the support plate 31 of the forcing means overcomes the elastic suspension of the elastic springs 36*a* and 36*b* by the air resistance, thereby being rotated to the opposite direction of the downswing centering around the hinges 33.

Accordingly, the force exerted by the forcing means is released, thereby releasing the accelerated force of the folding shafts 20*a* and 20*b* and the head 10.

In this case, the folding shafts 20*a* and 20*b* are folded since the accelerating force of the forcing means is released. But the head 10 produces no force to reduce the rotational torque since unless a force is applied to the grip 13. And the head 10 maintains its rotational torque attained by the inertial and centrifugal forces. Thus, the golf ball can experience a strong impact performed by the user.

During follow-through after the impact, the head 10 is prevented from being displaced by the bending-prevention panel 23 to the left of the center line A of die shaft 14. And, at the peak of the follow-through, the support plate 31 is restored by the elastic springs 36*a* and 36*b* since there is no more air-resistance, thereby becoming the state as good as FIG. 5.

The practice golf club according to the present invention fails to provide a natural downswing when an excessive force is exerted on the grip 13 by the user during downswing.

Figure 11:
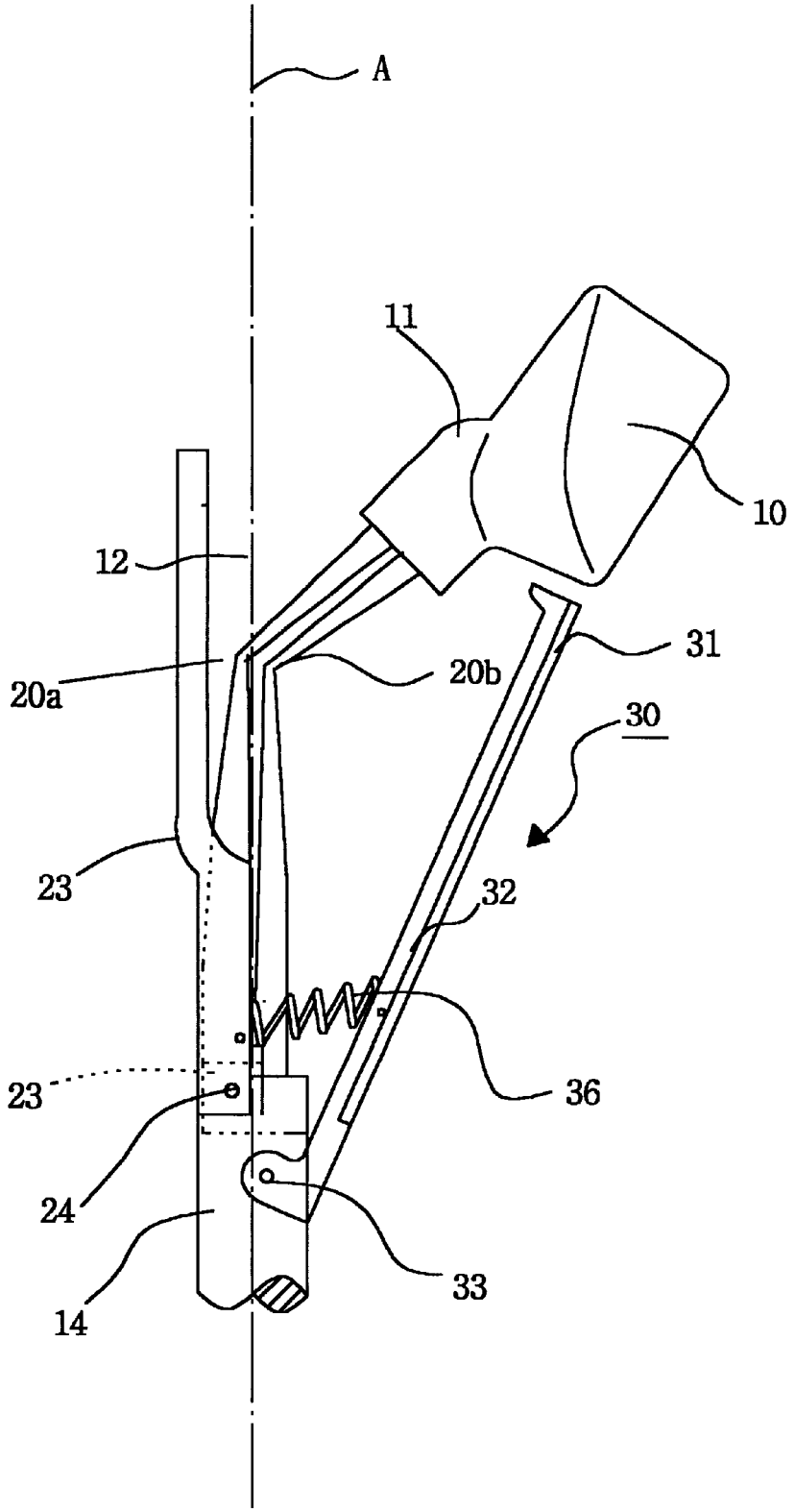

Namely, once a force is exerted on the grip 13 of the practice golf club of the present invention during downswing, as shown in FIG. 11, the support plate 31 overcomes the elastic suspension of the elastic springs 36*a* and 36*b* by the air-resistance, thereby rotating to the opposite direction of the downswing centering around the hinges 33.

Accordingly, the folding shafts are folded since the force pressing the head 10 and the folding shafts 20*a* and 20*b* are released.

In this case, once a force is applied to the grip 13, an anti-force is generated reducing the rotational torque of the head 10 which is produced by the inertial and centrifugal forces of the head 10.

Once the anti-force(enough to fold the folding shafts) reducing the rotational torque of the head 10 is activated, the folding shafts 20*a* and 20*b* are folded.

Thus, the user is unable to perform a correct downswing since the folding shafts 20*a* and 20*b* are folded indicating that an unnecessary external force has been exerted on the grip 13.

Accordingly, the practice golf club according to the present invention enables a user to practice not applying an excessive force reducing a rotational torque of the head 10 on the grip 13 repeatedly, thereby learning not to exert excessive force on the grip.

As mentioned in the above description, the practice golf club according to the present invention provides a downswing practice maintaining the original rotational torque attained by the centrifugal and inertial forces of the head without an excessive force on the grip as well as to provide the same practice effect of the general golf club for the address, backswing, and downswing stances.

Accordingly, the practice golf club according to the present invention prevents excessive force from being exerted on the grip by a golf beginner during downswing, thereby improving the accuracy of the impact and the driving range of the impacted golf ball.

It will be apparent to those skilled in the art that various modifications and variations can be made in a practice golf club of the present invention without departing from the spirit or scope of the inventions. Thus, it is intended that the present invention cover the modifications and variations of this invention provided they come within the scope of the appended claims and equivalents.

What is claimed is:

1. A practice golf club including a grip configured to be grabbed by a golfer's hands, a head configured to impact with a golf ball, and a shaft connecting the grip to the head, comprising:

a pair of folding shafts, one end of which is fixed to a neck of the head and the other end of which is fixed to the shaft, wherein the folding shafts are folded when a force is exerted on the grip during downswing;

a bending-prevention means fixed to the shaft to prevent the head from being bent during follow-through after impact with the golf ball, wherein the bending-prevention means is fixed to prevent the head from moving in a direction left of a center line of the shaft; and a forcing means attached rotatively to the shaft, wherein the head receives a force by the forcing means during address and backswing, and wherein the folding shafts are folded during downswing by releasing the force of the head.

2. The practice golf club according to claim 1, wherein the folding shafts comprise a pair of hemi-elliptical elastic panels, one end of which is fixed to the neck and the other end of which is fixed to protuberances of a keeper inserted and fixed into an opening of the shaft.

3. The practice golf club according to claim 1, wherein the bending-prevention means is a hemi-elliptical bending-prevention panel, one end of which is fixed to the shaft and the other end of which is extended to the neck.

4. The practice golf club according to claim 1, the forcing means further comprising:

a support plate;

a support attached to one side of the support plate and coupled with the shaft rotatively; and elastic springs both ends of which are fixed to the support and the bending-prevention panel, respectively, wherein the elastic springs define a displacement of the support plate within a predetermined distance during downswing.

* * * * *